US008347571B2

(12) United States Patent
Fehr et al.

(10) Patent No.: US 8,347,571 B2
(45) **Date of Patent: *Jan. 8, 2013**

(54) STRUCTURAL COLUMN WITH FOOTING STILT

(75) Inventors: Dave Fehr, Morton, IL (US); Wayne A. Knepp, Morton, IL (US); Paul Remmele, Morton, IL (US)

(73) Assignee: Morton Buildings, Inc., Morton, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/209,204

(22) Filed: Aug. 12, 2011

(65) Prior Publication Data

US 2011/0296770 A1 Dec. 8, 2011

Related U.S. Application Data

(60) Continuation of application No. 13/165,116, filed on Jun. 21, 2011, which is a division of application No. 11/277,069, filed on Mar. 21, 2006, now Pat. No. 7,980,034.

(60) Provisional application No. 60/677,161, filed on May 2, 2005.

(51) Int. Cl.
*E02D 27/00* (2006.01)

(52) U.S. Cl. ..... 52/297; 52/169.13; 52/165; 248/519

(58) Field of Classification Search ..... 22/2.21, 22/165, 169.13, 294, 295, 296, 297, 298, 22/736.4, 170, FOR. 119, 741.15; 248/519, 248/676, 679; 256/65.14, DIG. 5; 173/493, 173/45 R See application file for complete search history.

(56) References Cited

U.S. PATENT DOCUMENTS

| | | | | |
|---|---|---|---|---|
| 284,219 | A * | 9/1883 | Mehew | 52/154 |
| 405,658 | A | 6/1889 | Campany | |
| 498,559 | A | 5/1893 | Marsh | |
| 519,445 | A | 5/1894 | Cooper | |
| 887,217 | A * | 5/1908 | Oliphant | 52/295 |
| 976,879 | A | 11/1910 | Hughs | |
| 985,681 | A | 2/1911 | Konopinski | |
| 1,243,933 | A | 10/1917 | Harding | |
| 1,290,563 | A | 1/1919 | James | |
| 1,292,012 | A | 1/1919 | Morris | |
| 1,358,951 | A | 11/1920 | Helmich | |
| 1,544,863 | A | 7/1925 | Ross | |
| 1,555,945 | A | 10/1925 | Cuttle et al. | |

(Continued)

*Primary Examiner* — William Gilbert
*Assistant Examiner* — James Ference
(74) *Attorney, Agent, or Firm* — Howard & Howard Attorneys PLLC

(57) ABSTRACT

A structural column assembly of the type used for erecting building structures and the like is bedded in a concrete footing formed in situ in an earthen hole. The column assembly includes a post whose bottom end is suspended above a floor of the hole by a stilt. The stilt includes a plurality of legs which extend from the post's bottom end and grip the hole floor through a plurality of cleats. The cleats help stabilize the column assembly during the concrete pour operation so that it does not shift out of position. The stilt legs are provided with a base pad, which is set below the bottom end of the post at a predetermined distance so that the concrete footing can be poured in a single operation immediately after the hole is formed. The stilt can accommodate posts made from wood, pre-cast concrete or any other known construction material. The stilts can be manufactured from formed flat steel or commercially available angle iron and channel stock.

25 Claims, 8 Drawing Sheets

U.S. PATENT DOCUMENTS 1,561,193 A * 11/1925 Spring ..... 52/170
1,564,109 A 12/1925 Ponsolle
1,599,250 A 9/1926 Schatz
1,811,899 A * 6/1931 Spring ..... 52/170
1,965,639 A 7/1934 Glass
1,979,580 A * 11/1934 Spring ..... 52/170
2,110,863 A * 3/1938 Barnett ..... 52/101
2,135,389 A 11/1938 Dempsey
2,790,524 A 4/1957 Herrschaft
2,826,281 A 3/1958 Johnson
2,947,149 A 8/1960 Barkley, Jr.
3,332,247 A 7/1967 Proctor
3,342,444 A 9/1967 Nelson
3,413,773 A * 12/1968 Fitzgerald ..... 52/713
3,514,911 A 6/1970 Preradovich
4,004,383 A 1/1977 Watanabe
4,047,356 A 9/1977 DePirro
4,099,354 A 7/1978 DePirro
4,117,643 A * 10/1978 Lamothe ..... 52/699
4,120,125 A 10/1978 Cvetan
4,156,332 A 5/1979 Thompson
4,192,118 A * 3/1980 Gilb ..... 52/714
4,199,908 A * 4/1980 Teeters ..... 52/295
4,202,149 A * 5/1980 Betrue, Sr. ..... 52/699
4,218,858 A 8/1980 Legler
4,229,919 A 10/1980 Hughes
4,272,929 A * 6/1981 Hanson ..... 52/40
4,312,160 A * 1/1982 Wilbanks ..... 52/92.1
4,387,543 A * 6/1983 Tschan et al. ..... 52/295
4,434,600 A * 3/1984 Backman ..... 52/742.15
4,455,795 A * 6/1984 Cole ..... 52/155
4,543,757 A 10/1985 Cosgrove
4,570,409 A 2/1986 Wilks
4,644,713 A * 2/1987 Lehman ..... 52/165
4,646,489 A 3/1987 Feller et al.
4,872,298 A * 10/1989 Klemic, Jr. ..... 52/127.1
4,923,165 A * 5/1990 Cockman ..... 248/545
4,924,648 A * 5/1990 Gilb et al. ..... 52/295
5,020,605 A 6/1991 Leishman
5,027,575 A 7/1991 Owen et al.
5,039,256 A 8/1991 Gagliano
5,050,356 A 9/1991 Johnson et al.
5,060,435 A 10/1991 Bogdanow
5,104,265 A 4/1992 Halloran, Jr.
5,133,164 A 7/1992 Legler
5,203,817 A * 4/1993 Klumpjan ..... 52/298
5,337,534 A * 8/1994 Nasca ..... 52/745.21
5,375,384 A * 12/1994 Wolfson ..... 52/295
5,392,573 A 2/1995 Gould
5,396,743 A 3/1995 Bellette
5,404,682 A 4/1995 West
5,426,267 A 6/1995 Underhill et al.
5,456,051 A 10/1995 Queen et al.
5,501,048 A * 3/1996 Nakanishi ..... 52/296
5,542,549 A 8/1996 Siemon et al.
5,547,315 A 8/1996 Halloran, Jr.
RE35,322 E 9/1996 Owen et al.
5,575,130 A * 11/1996 Chiodo ..... 52/713
5,636,482 A 6/1997 Klager
5,666,774 A * 9/1997 Commins ..... 52/298
5,699,639 A * 12/1997 Fernandez ..... 52/707
5,740,645 A * 4/1998 Raby ..... 52/297
5,749,189 A * 5/1998 Oberg ..... 52/298
5,765,333 A * 6/1998 Cunningham ..... 52/481.1
5,857,664 A 1/1999 Schauman
5,901,525 A * 5/1999 Doeringer et al. ..... 52/835
5,966,882 A * 10/1999 Naito ..... 52/295
5,970,677 A * 10/1999 Masters et al. ..... 52/712
6,089,973 A 7/2000 Schultz
6,098,351 A 8/2000 Mills
6,161,360 A 12/2000 Smith
6,202,369 B1 3/2001 Partee et al.
6,398,392 B2 6/2002 Gordin et al.
6,401,411 B1 6/2002 Maglio, Jr.
6,513,290 B2 * 2/2003 Leek ..... 52/295
6,585,454 B1 7/2003 Fisher et al.
6,658,806 B1 * 12/2003 Leek ..... 52/295
6,732,673 B2 5/2004 Hughes et al.
6,964,139 B2 * 11/2005 Meyer et al. ..... 52/299
7,137,228 B2 * 11/2006 Wagner ..... 52/295
7,168,343 B2 * 1/2007 Leek et al. ..... 81/176.1
7,287,355 B2 * 10/2007 Commins ..... 52/223.14
7,296,386 B2 * 11/2007 Leek ..... 52/296
7,444,787 B2 11/2008 Cutforth
7,454,872 B2 11/2008 Cutforth
7,621,097 B2 * 11/2009 Wilhour ..... 52/741.15
D607,711 S * 1/2010 Adams et al. ..... D8/354
7,980,034 B2 * 7/2011 Fehr et al. ..... 52/297
2002/0066247 A1 * 6/2002 Leek ..... 52/295
2003/0136068 A1 * 7/2003 Forbis et al. ..... 52/296
2006/0037265 A1 * 2/2006 Leek ..... 52/295
2006/0067794 A1 * 3/2006 Mitchell ..... 405/230
2006/0201087 A1 9/2006 Cutforth
2006/0275085 A1 * 12/2006 Ong ..... 405/230
2007/0084137 A1 * 4/2007 Pasto ..... 52/170

* cited by examiner

STRUCTURAL COLUMN WITH FOOTING STILT

CROSS-REFERENCE TO RELATED APPLICATIONS

This application is a continuation of U.S. patent application Ser. No. 13/165,116, filed on Jun. 21, 2011, which is a divisional of U.S. patent application Ser. No. 11/277,069, filed on Mar. 21, 2006 and now U.S. Pat. No. 7,980,034, issued on Jul. 19, 2011, and claims priority to U.S. Provisional application No. 60/667,161, filed Mar. 31, 2005. The disclosures of the aforementioned applications are incorporated herein.

BACKGROUND OF THE INVENTION

1. Field of the Invention

The invention relates generally to a structural column assembly such as used to support framing members in the construction of buildings, structures and the like; and more particularly toward a column assembly including a footing stilt for supporting the bottom end of a column post a predetermined distance above the floor of an earthen hole to facilitate the in situ formation of a concrete footing.

2. Related Art

Structural column assemblies of the type used for post-frame construction and pole frame structures typically include an elongated wooden post having a bottom end anchored in the earth and a top, free standing end fixed in an upright position upon which framing, truss or other structural elements are attached. The bottom end of the post is typically supported in the earthen hole by either back-filled dirt or gravel or perhaps by concrete formed in situ thereabout.

In many applications, building codes require a concrete footing of perhaps 8 inches or 12 inches, for example, to be formed under the bottom of the column post. In common practice, numerous steps carried out over several days of job-site construction are required to properly set a single structural column assembly. As a first step, an earthen hole is dug to the prescribed depth and then filled partially with uncured concrete to form a footing of specified thickness. Once the concrete footing is sufficiently hardened, the bottom end of the post can be set in the hole, resting upon the cured concrete footing, whereupon it is temporarily supported in an upright posture with outrigger bracing and the remainder of the hole filled with either more concrete, or back-filled with gravel, dirt or other suitable materials. Accordingly, at least two trips to the job site are required, over a span of days, in order to set a post in an upright posture according to the prior art. These multiple trips to the job site increase the overall project cost, as well as extend the duration of the construction phase.

Another issue commonly encountered in the erection of structural column assemblies is the issue of uplift. Uplift is a phenomenon caused usually by strong winds acting upon a building, urging it to lift away from its foundation. An extreme example of uplift can be understood from a tornado or hurricane situation, in which an entire building can be pulled from its foundation. In order to combat the negative effects of uplift in both its mild and more severe forms, it is common to provide some kind of anchoring device for securing the bottom end of the post in its earthen hole. In the case where concrete is poured in situ into an earthen hole around the exterior of the post, it is sometimes a practice to affix laterally extending bolts or metallic pins to the bottom end of the post, which become embedded in the concrete and operative to resist uplift. Other anchoring methods have been proposed, all of which aim to combat the foreseeable problem of uplift.

In a tangentially related field, the prior art has taught the use of pre-formed metallic stilts to be attached to the bottom end of a post for use in light duty applications. In other words, for fence and signpost applications, it is known to attach a metallic stand or cage-like device to the bottom end of a post, and then set that so-called stilt into an earthen hole. For example, U.S. Pat. No. 4,543,757 to Cosgrove, issued Oct. 1, 1985, discloses a stilt attached to a light duty post, with concrete poured around the lower portion of the stilt. The stilt supports a square post at two opposite corners. Each stilt portion comprises an angled L-shaped member that supports extend longitudinally from the bottom end of the post. Fasteners are used to attach the post to the upper end of the stilt. The fasteners are exposed above the earthen hole and above the concrete footing so that the post can be replaced if it is damaged.

Similarly, U.S. Pat. No. 4,096,677 to Gilb, issued Jun. 27, 1978 discloses a similar stilt-like assembly which is attached to the bottom end of a light-duty post. The stilt is fastened to the bottom end of the post by fasteners which, like those disclosed in Cosgrove '757, are exposed above the earthen hole so that the post can be easily replaced if damaged. Similar examples of prior art stilt constructions may be found in U.S. Pat. Nos. 887,217 to Oliphant, 1,292,012 to Morris, 1,378,351 to Hoyle, and 4,924,648 to Gilb et al. It is not always desirable to see or otherwise be required to work around exposed fasteners.

In addition to these prior art examples which include fastening arrangements exposed above the earthen hole, they all include another deficiency. More particularly, when forming a concrete footing in situ in an earthen hole, the viscous, heavy concrete is likely to urge the bottom end of the post out of the preferred orientation. If the external, temporary bracing is not sufficiently strong, the poured concrete can cause the column assembly to shift in its earthen hole, resulting in a mis-set shifted orientation in the permanent, cured state. Because construction workers who are employed during this phase of a construction project are typically under time pressures and may not be disposed to correct for shifting during the pour, this situation can result in serious errors.

Accordingly, there is a need in the prior art for a structural column assembly of the type fixed in an earthen hole and embedded in a concrete footing formed in situ which includes a stilt assembly that overcomes the disadvantages and shortcomings existing in the prior art.

SUMMARY OF THE INVENTION AND ADVANTAGES

The subject invention comprises a structural column assembly embedded in a concrete footing formed in situ in an earthen hole. The assembly comprises an earthen hole having a longitudinal depth measured from a surrounding grade surface to a floor thereof. The longitudinally extending post has a top end and a bottom end. The bottom end of the post is disposed in the earthen hole and is suspended between the floor and the grade surface. A stilt is disposed in the earthen hole and fixedly attached to the bottom end of the post. The stilt engages the floor of the earthen hole and is operative to temporarily stabilize the post in the earthen hole in a generally upright orientation with its bottom end spaced a predetermined distance above the floor. A hardened concrete footing in the hole and envelops at least a portion of the stilt. At least one fastener interconnects the post and the stilt, with the fastener being disposed entirely within the earthen hole and recessed below the grade surface whereby its presence in the column assembly may be undetectable upon inspection of the post above the grade surface.

According to another aspect of the invention, a method is provided for setting a structural column assembly in an upright orientation and embedded within a concrete footing formed in situ in an earthen hole. The method comprises the steps of forming an earthen hole having a longitudinal depth measured from a surrounding grade surface to a floor thereof, providing a longitudinally extending post having a top end and a bottom end, affixing a stilt to the bottom end of the post, placing the stilt into the hole against the floor to temporarily stabilize the post in a generally upright orientation with its bottom end spaced a predetermined distance above the floor, pouring uncured concrete into the hole and enveloping at least a portion of the stilt and the bottom end of the post. The step of affixing the stilt to the bottom end of the post includes securing at least one fastener therebetween and fully recessing the fastener below the grade surface whereby its presence in the column assembly may be undetectable upon inspection of the post above the grade surface.

Accordingly, the subject invention recesses its fasteners between the stilt and the post below grade surface so that they cannot be seen, do not interfere with the attachment of additional construction members, and are not subject to the same type of corrosion and environmental concerns as found in the prior art.

According to yet another aspect of the invention, a structural column assembly of the type for bedding in a concrete footing formed in situ in a earthen hole is provided. The assembly comprises a longitudinally extending post having a top end and a bottom end. A stilt is fixedly attached to the post and extends longitudinally from the bottom end thereof. The stilt includes a base pad for establishing a generally perpendicular resting surface for the column assembly against the floor of the earthen hole to temporarily stabilize the post in a generally upright orientation. The improvement comprises at least one cleat extending below the base pad for piercing the floor of the earthen hole to resist inadvertent shifting movement of the column assembly prior to the introduction and hardening of concrete in the earthen hole.

A counterpart method according to this aspect of the invention is provided for setting a structural column assembly in an upright orientation embedded within a concrete footing formed in situ in an earthen hole. The method comprises the steps of forming an earthen hole having a longitudinal depth measured from a grade surface to a floor thereof, providing a longitudinally extending post having a top end and bottom end, providing a stilt having a generally planar base pad, affixing the stilt to the post with the base pad spaced longitudinally from the bottom end and oriented generally perpendicular to the longitudinal extent of the post, placing the stilt into the hole with the base pad resting against the floor to temporarily stabilize the post in a generally upright orientation, and pouring concrete in an uncured, fluidic form into the hole and enveloping at least a portion of the stilt and the bottom end of the post. The improvement here comprises piercing the floor of the hole with at least one cleat extending below the base pad and below the concrete footing so as to resist inadvertent shifting movement of the column assembly prior to the step of pouring concrete in the hole.

Thus, the subject invention as defined by these later expressions of the invention are effective to resist inadvertent shifting of the column assembly out of its predetermined orientation during the concrete pouring step. Therefore, a column assembly made in accordance with this aspect of the invention is more likely to remain in its preferred orientation and location even if the construction workers are not particularly careful or if they do not properly set temporary brace structures prior to the step of pouring the concrete in the hole.

BRIEF DESCRIPTION OF THE DRAWINGS

These and other features and advantages of the present invention will become more readily appreciated as the same becomes better understood by reference to the following detailed description when considered in connection with the accompanying drawings, wherein.

DETAILED DESCRIPTION OF THE PREFERRED EMBODIMENT

Figure 1:
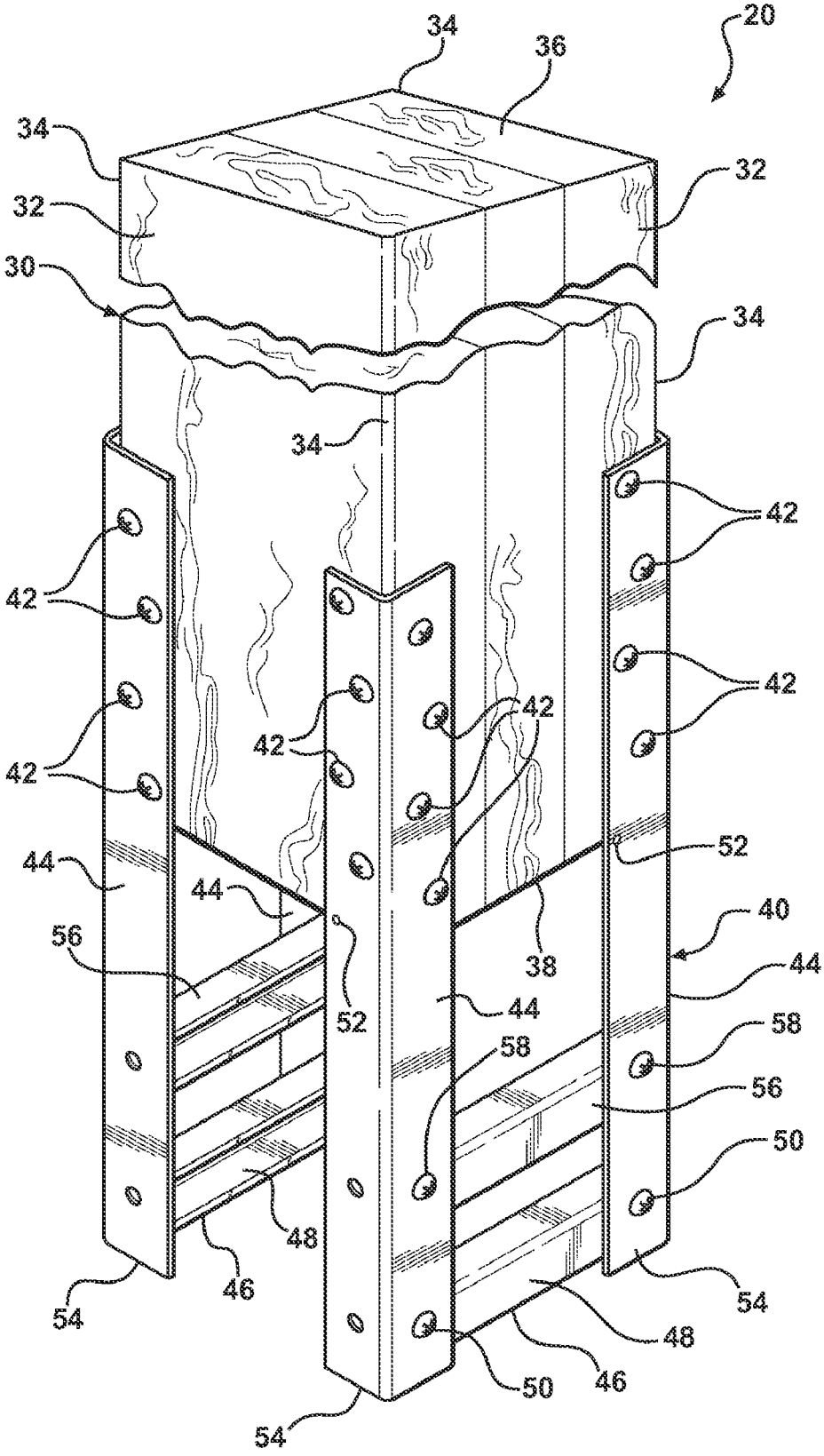
FIG. 1 is a perspective view of a structural column assembly according to the subject invention.

Referring to the Figures, wherein like numerals indicate like or corresponding parts throughout several views, a structural column assembly according to the subject invention is generally shown at 20 in FIG. 1-4D. The column assembly 20 is of the type adapted to be embedded in a concrete footing, generally indicated at 22 in FIGS. 4B-4D. The concrete footing 22, in turn, is preferably not of the pre-cast type, but rather of that type formed in situ in an earthen hole 24. The hole 24 is formed by any of the known techniques, including digging or boring to a depth which is prescribed by local building codes or customs. The depth can be measured longitudinally from the surrounding grade surface 26 to a floor 28 of the hole 24. Typically, the hole 24 will be cylindrical in form, but other shapes are possible. And, while the preferred implementation of the subject column assembly 20 contemplates forming the hole 24 in the earth per se, it must be appreciated that foreseeable circumstances may require formation of a hole in some substance other than earth, and that such hole 24 remains within the meaning of earthen hole 24 is used throughout.

The column assembly 20 further includes a longitudinally extending post, generally indicated at 30, of the type typically made from chemically treated wood, although other post compositions are certainly within the scope of this invention. In the example depicted in FIG. 1 for example, the post 30 is fabricated from a lamination of three so-called 2× members. Depending upon the application, these 2× members may be 2×6, 2×8, 2×10, etc. This results in a post 30 having four planar exterior faces 32 with longitudinally extending corners 34 formed at the intersection of adjacent faces 32. While this is a typical geometric configuration for posts used extensively throughout the construction industry, it will be appreciated that posts 30 having other shapes, including round cross-sections, are contemplated and within the scope of this invention.

The post 30 includes a top end 36 and a bottom end 38. The bottom end 38 forms that portion of the post 30 which is disposed in the hole 24 and, according to this invention, is suspended at a predetermined distance between the floor 28 and the grade surface 26. The predetermined distance is variable, and dictated by the application and by local building codes or customs. This predetermined distance between the bottom end 38 of the post 30 and the floor 28 is filled with the concrete footing 22 and forms a structural foundation for any subsequent building or other structure which may be constructed around the column assembly 20. For example, for structures which experience unusually high snow loads or which are very heavy for other reasons, the predetermined distance the bottom end 38 of the post 30 and the floor 28 of the hole 24 may be on the order of 12 inches or more. Whereas, for lighter duty applications such as pole barns or livestock shelters as may be found in mid-western states of the United States, the predetermined distance between the bottom end 38 of the post 30 and the hole floor 28 may be on the order of 8 inches. These distances are provided for illustrative purposes only, and are not to be taken as limiting in any way.

Figure 2:
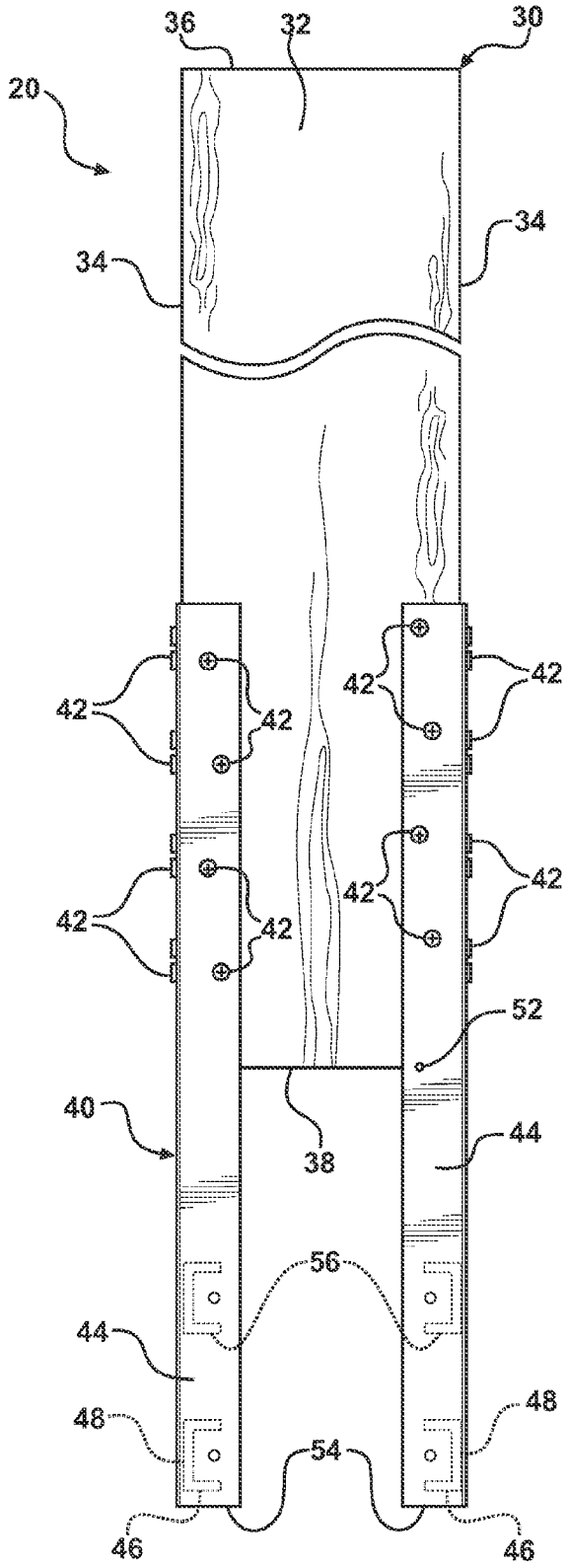
FIG. 2 is a front elevation view of the column assembly shown in FIG. 1.
Figure 3:
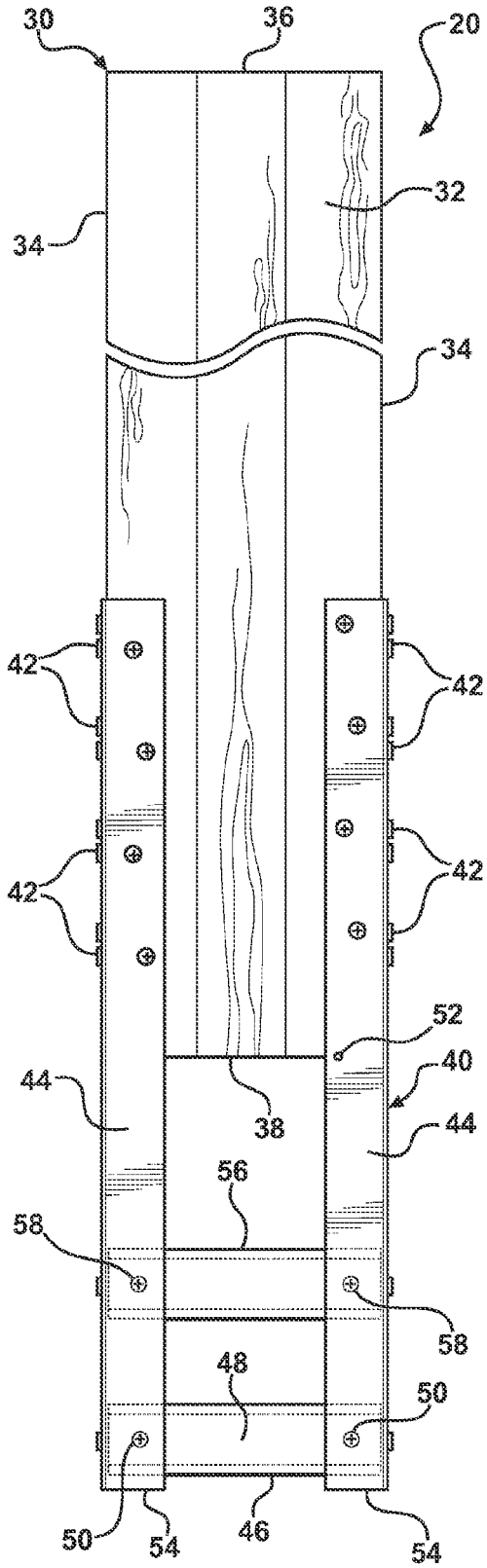
FIG. 3 is a side elevation view of the column assembly.

The column assembly 20 further includes a stilt, generally indicated at 40. Preferably, although not necessarily, the stilt 40 comprises a cage-like metallic structure affixed to the bottom end 38 of the post 30. The stilt 40 is disposed in the earthen hole 24 and engages the floor 28 so as to temporarily stabilize the post 30 in a generally upright orientation extending upwardly, out of the hole 24. The stilt 40 is effective to establish the spaced, predetermined distance between the bottom end 38 of the post 30 and the floor 28 of the hole 24. In other words, the stilt lifts the bottom end 38 of the post 30 above the floor 28 to reliably maintain and achieve the predetermined distance needed to accomplish the required foundation thickness of the concrete footing 22. The stilt 40 is attached to the post 30 using one or more fasteners 42. As shown in FIGS. 1-3, these fasteners 42 may comprise appropriately sized nails driven to and securely seating in the wooden fabric of the post 30. Alternatively, the fasteners 42 may comprise screws or even a bolt as will be described in connection with FIG. 5 below.

In a preferred embodiment of the invention, the stilt 40 includes a plurality of discrete legs 44 all extending generally parallel to the longitudinal extent of the post 30. In other words, the legs 44 extend straight down as if an extension of the post 30 itself. For structural integrity and economy reasons, the legs 44 may be manufactured from formed flat steel or commercially available angle iron, which is characterized by an L-shaped cross-section. In this configuration, the legs 44 can be placed over the respective corners 34 of the post 30, with the fasteners 42 driven into adjacent surfaces thereby providing multiple vectors of fixation. This results in a sturdy, stable attachment of each leg 44 to the post 30. Accordingly, in the preferred embodiment depicted here, four such legs 44 extend from each of the four corners 34 of the post 30 downwardly into the hole 24 to support the post 30 above the floor 28.

The stilt 40 further includes a base pad 46 for establishing a generally perpendicular resting surface for the column assembly 20 against the floor 28 of the hole 24. The base pad 46 functions to temporarily stabilize the post 30 in a generally upright orientation to facilitate further operations such as exterior column stabilization and concrete filling. In this embodiment, the base pad 46 is formed by a plurality of discrete members which function also to reinforce the stilt 40. These discrete members here take the form of a pair of lower reinforcing members 48 each having a generally U-shaped cross-section. The U-shaped cross-section provides structural integrity and allows the lower reinforcing members 48 to be manufactured from formed flat steel or commercially available channel stock. Those skilled will understand that other configurations of the lower reinforcing members 48, i.e., other than channel stock, can be used without departing from the spirit of the invention. Therefore, in this embodiment, the base pad 46 exists as the lower most horizontal surface of the U-shaped channels which comprise the lower reinforcing members 48. As will be seen in later embodiments, the base pad can take other forms. Preferably, the lower reinforcing members 48 connect two adjacent legs 44 and are secured in place by rivets 50 or other suitable fastening techniques which may include welding or the like.

The longitudinal distance between the base pads 46 and the bottom end 38 of the post 30 comprises the predetermined distance at which the bottom end 38 must be set above the hole floor 28. According to this embodiment of the invention, the stilt 40 can be adjusted somewhat in the location of its attachment to the post 30 such that the predetermined distance can be set differently from one job to the next. In order to facilitate attachment of the stilt 40 in the proper location, one or more markers 52 can be provided on the legs 44 to aid in the assembly. As shown in FIGS. 1-3, the markers 52 may comprise simple visual indicators on each leg 44 which, when aligned with the bottom end 38 of the post 30, insure accurate spacing to the base pads 46. If, for example, the markers 52 are set at the standard 8 inch foundation mark, the resulting predetermined distance will be set at 8 inches. Of course, multiple markers 52 may be used to provide greater variability for use in different applications.

To further stiffen and add uplift resistance to the stilt 40, upper reinforcing members 56 can be added between adjacent legs 44. Like the lower reinforcing members 48, these upper reinforcing members 56 can be manufactured from formed flat steel or commercially available channel stock and attached to the respective legs 44 using rivets 58 or other suitable devices. Although the upper reinforcing members 56 are depicted in a parallel orientation relative to the lower reinforcing members 48, they can be angled.

Figure 4A:
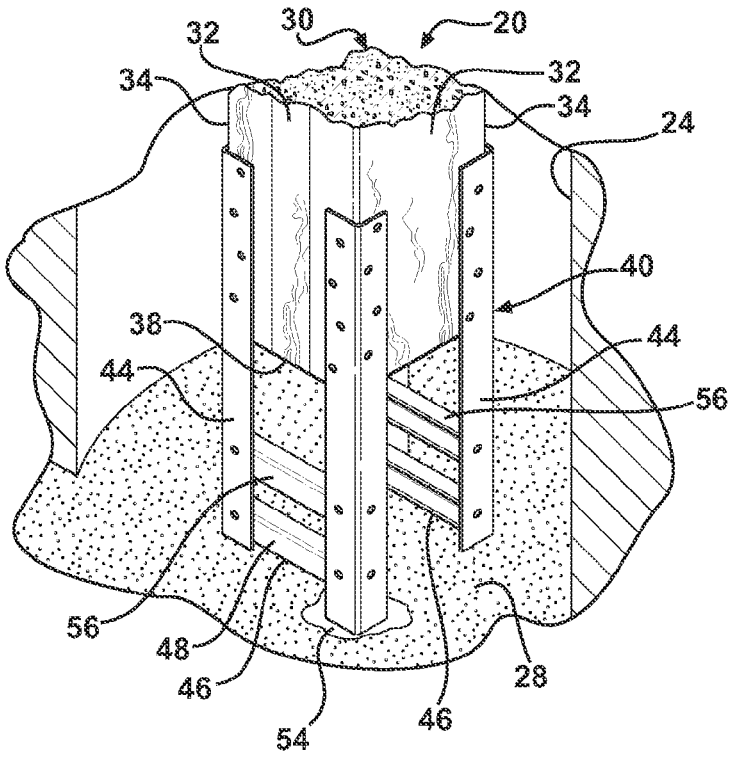
FIGS. 4A-D depict a progression through the steps of forming a concrete footing in situ in an earthen hole about the subject column assembly.
Figure 4B:
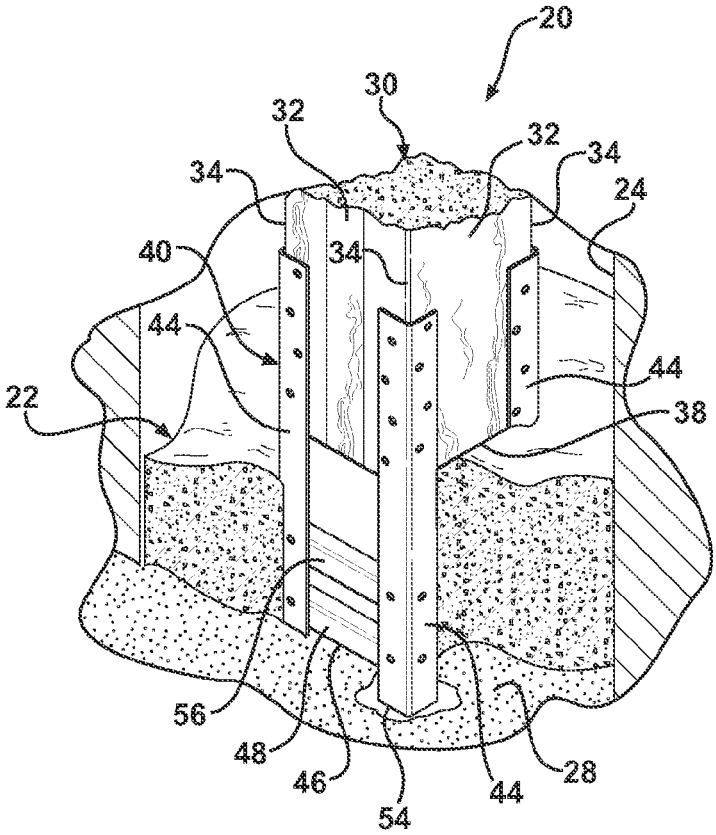
Figure 4C:
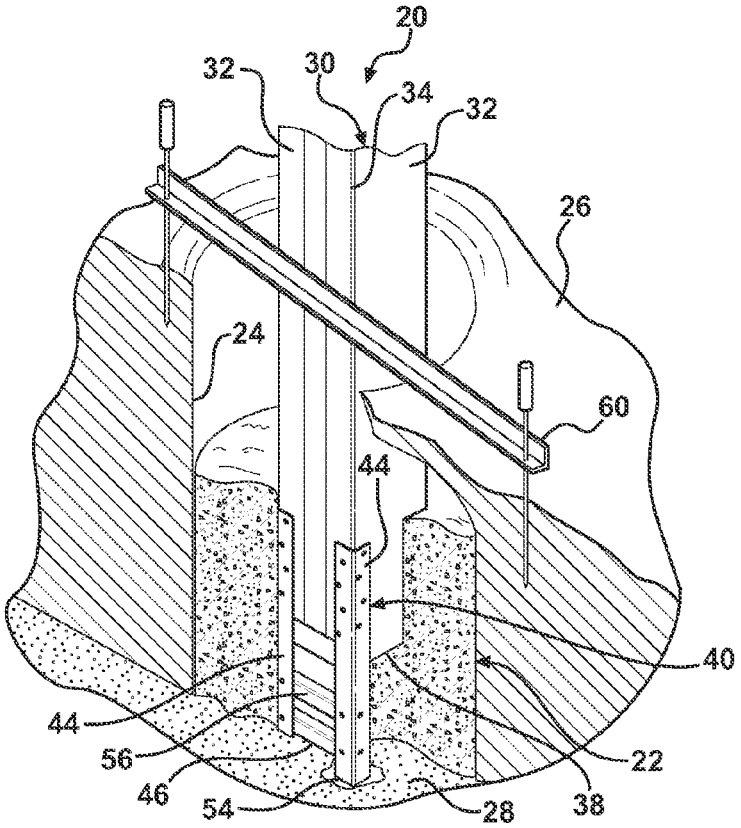

The stilt 40 further includes a plurality of cleats 54 extending below the base pad 46 and piercing the floor 28 of the hole 24. The cleats 54 function to resist inadvertent shifting movement of the column assembly 20 prior to the introduction and hardening of concrete 22 into the earthen hole 24, as shown in FIGS. 4A-C. In this embodiment of the invention, the cleats 54 comprise extensions from each of the legs 44 below the lower reinforcing members 48. Thus, each cleat 54 extends with the same L-shaped cross-section found in the integral legs 44. The length of each cleat 54, i.e., as measured from the base pad 46, can be variable but is preferably confined to a range which is long enough to provide sufficient grip in the floor 28 without impeding full surface-to-surface contact between the base pad 46 and the floor 28. In practice, cleat 54 lengths in the order 0.75-1.0 inches have been found to yield acceptable results. However, other lengths may be found suitable, depending upon soil conditions and other application variables. By utilizing a plurality of cleats 54, spaced apart one from another, the stilt 40 provides resistance against rotation as well as translation relative to the floor 28. This, in turn, results in a more stable support for the column assembly 20 during the concrete filling operation.

Referring now to FIGS. 4A-D, the method for setting the structural column assembly 20 in an upright orientation and embedded within the concrete footing 22 is depicted. Here, the stilt 40 and post 30 assembly is placed into the hole 24 with the base pad 46 resting thereagainst. The stilt 40 acts to temporarily help stabilize the post 30 in an upright orientation. The predetermined distance between the bottom end 38 of the post 30 and the floor 28 can be adjusted to suit local building codes or customs. Preferably, although not necessarily, the depth of the hole 24 is approximately twice the height of the overall stilt 40. By this measure, the upper ends of the legs 44 come to rest approximately half way between the floor 28 and the surrounding grade surface 26. This relationship is only an example, and the invention may be practiced otherwise than here described. Often, the hole depth is based on embedment requirements.

Figure 4D:
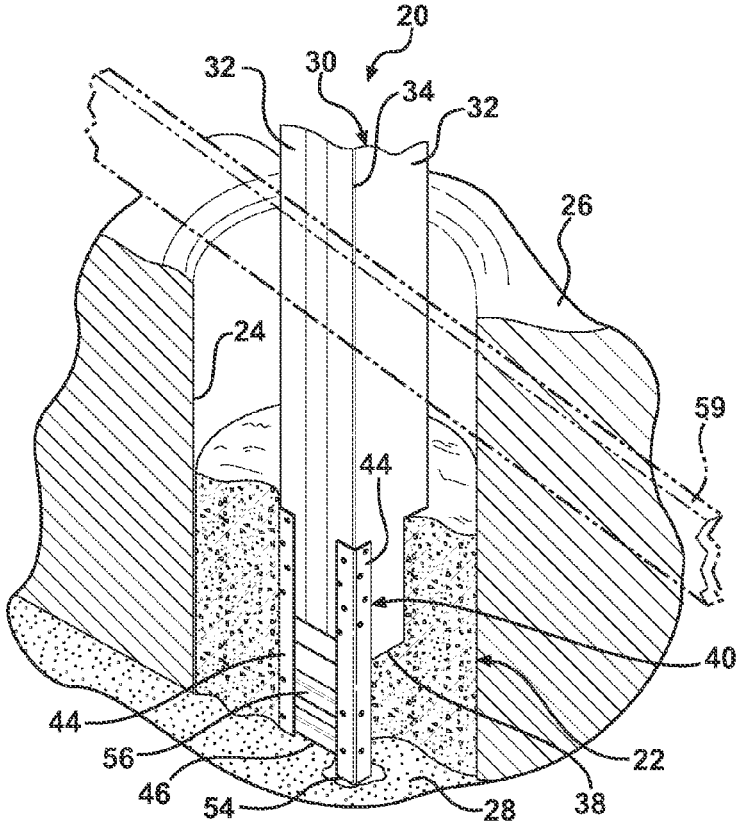

According to FIG. 4B, concrete is poured in an uncured, fluidic form into the hole 24 so that it completely fills the space below the bottom end 38 of the post 30. Later, when the concrete 22 has hardened, that portion of the concrete 22 below the bottom end 38 will function as a footing foundation for the resulting structure. Preferably, the concrete poured into the hole is continued so that it surrounds and envelops the bottom end 38 of the post 30 together with the entire stilt 40. That is, the entire portion of the legs 44, except the cleats 54, are encased in the concrete footing 22. Although, this fill depth for the concrete footing 22 can be adjusted with more or less concrete added to suit a particular application. The remainder of the hole 24 as shown in FIGS. 4C and 4D may be backfilled with dirt to the grade surface 26 or, if desired, concrete 22 can be filled all the way to the top.

To further stabilize the column assembly 20 during this pouring operation, a steel support angle or 2× framing 60 can be staked to the grade surface 26 and affixed to one face 32 of the post 30. This is a temporary measure, and the support angle or 2× framing 60 is removed after the concrete 22 is set. Once the concrete footing 22 is fully set, the lower reinforcing members 48, together with the upper reinforcing members 56 provide anchorage within the concrete 22 and provide uplift resistance to secure the column assembly 20 in high wind conditions. A portion of a building 59 is shown in phantom in FIG. 4D.

Figure 5:
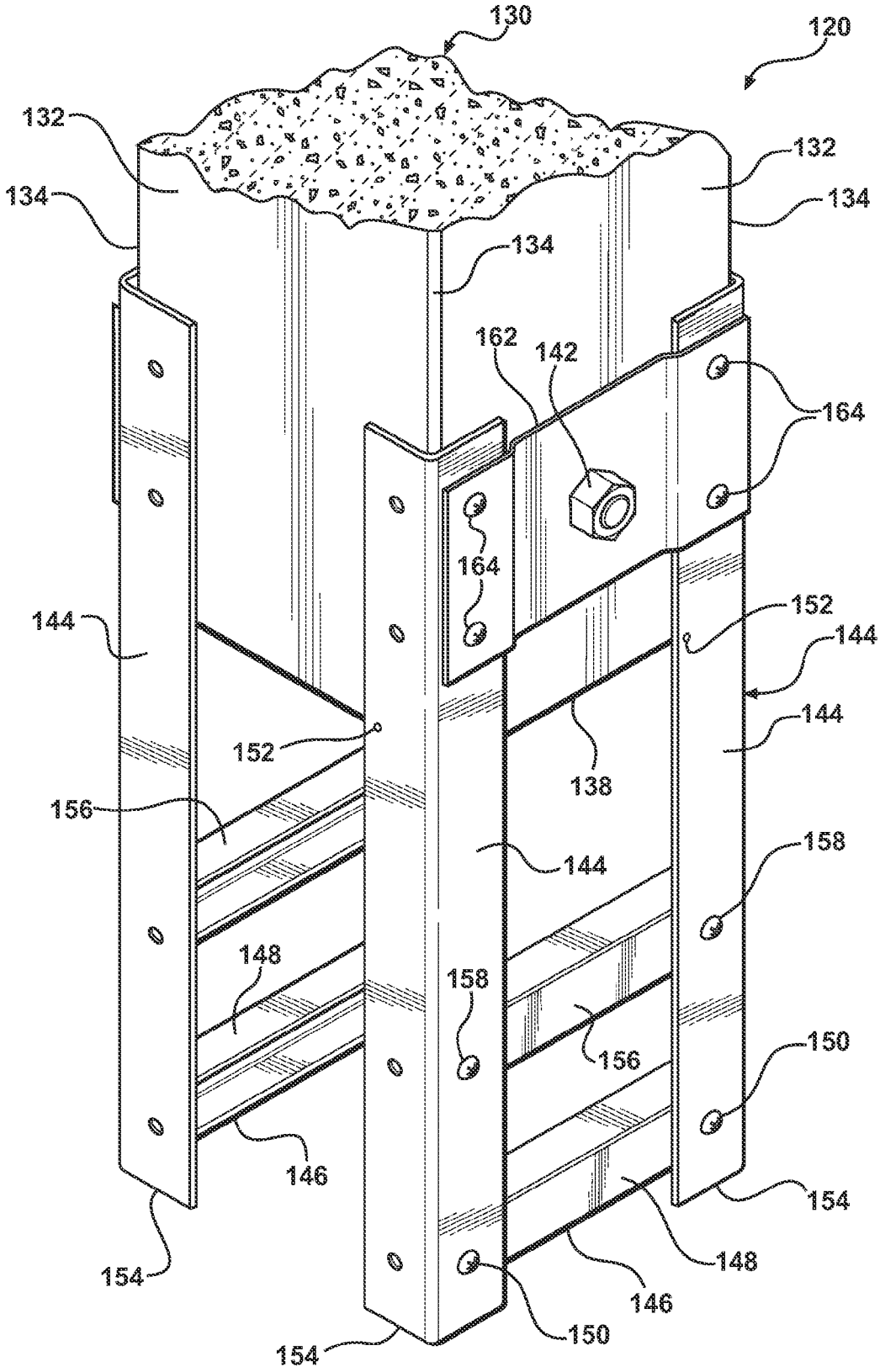
FIG. 5 is a fragmentary perspective view of a first alternative embodiment of the subject column assembly in which the post is fabricated from pre-cast concrete.

Referring now to FIG. 5, a first alternative embodiment of the subject invention is shown as a fragmentary perspective view with parts and components corresponding to those described above being identified with like reference numerals but preceded by the prefix "1". In this embodiment, the post 130 is of the type fabricated from a pre-cast concrete material. In such applications, the method of attaching the stilt 140 to the post 130 must be altered. In this case, the fastener 142 takes the form of an elongated bolt and threaded nut arrangement. A single such fastener 142 is used in conjunction with a modification to the stilt 140. The modification comprises a web plate 162 which is affixed to adjacent legs 144 near their upper ends by a plurality of rivets 164 or other suitable fasteners. The web plate 162 has a hole formed therein to receive the fastener 142. All other aspects of the subject invention are consistent with the column assembly 20 described above in connection with FIGS. 1-4D.

Figure 6:
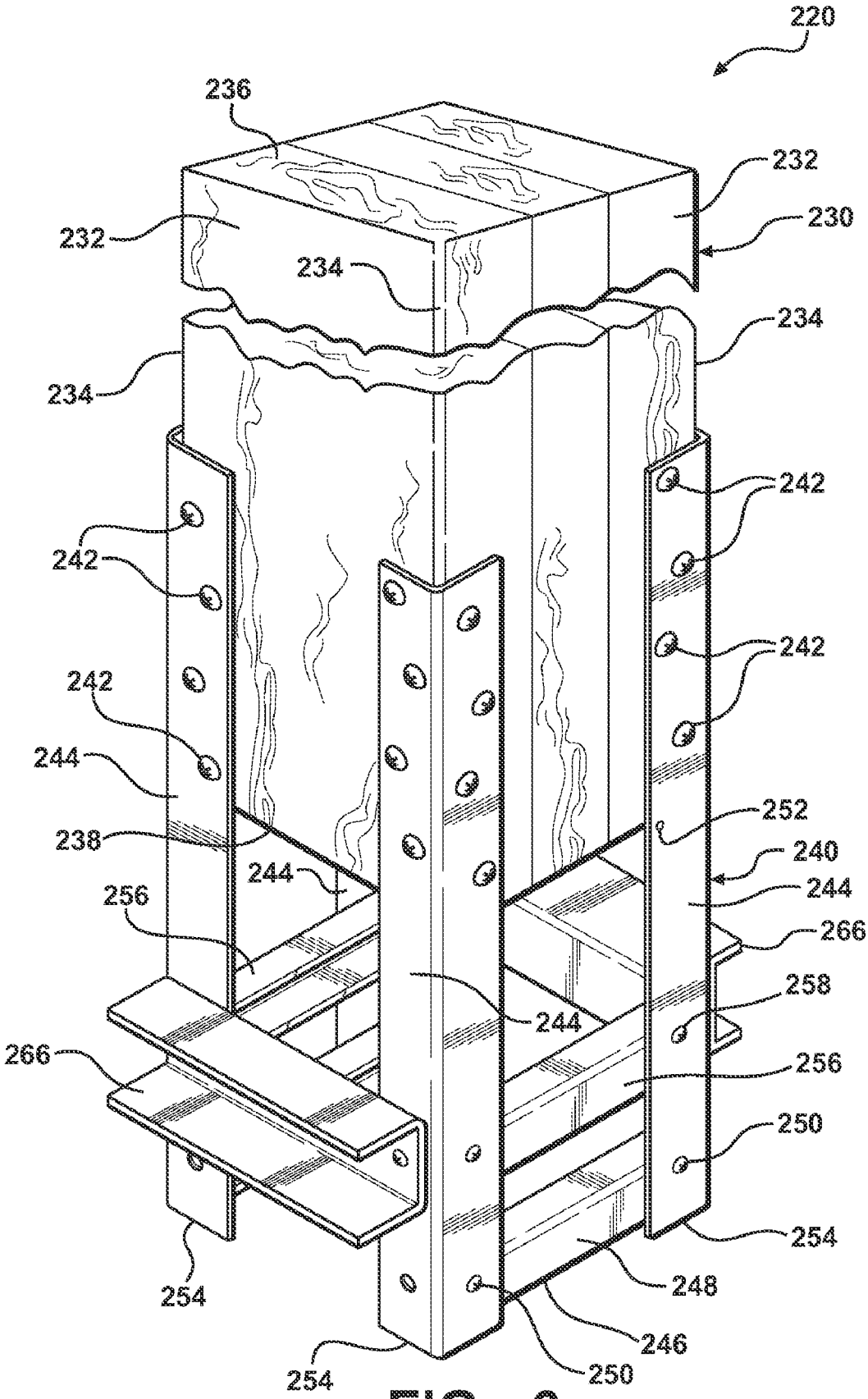
FIG. 6 is a perspective view as in FIG. 1 but depicting a second alternative embodiment of the subject column assembly.

FIG. 6 illustrates a second alternative embodiment of the subject invention, wherein like or corresponding parts are represented with similar reference numerals, preceded by the prefix "2". In this embodiment, which again illustrates the post 230 as a laminated wood construction, is distinguished from the original, preferred embodiment by the addition of a cross-member stiffener 266 attached between adjacent legs 244 at approximately the same elevation as the upper reinforcing members 256. Due to clearance space constraints, together with a desire for added uplift resistance capacity, the cross-member stiffeners 266 are affixed to the outside of the legs 244, with a U-shaped cross-section facing outwardly from the stilt 240. All other aspects, as well as the method for setting the column assembly 20, is identical to the preferred embodiment.

Figure 7:
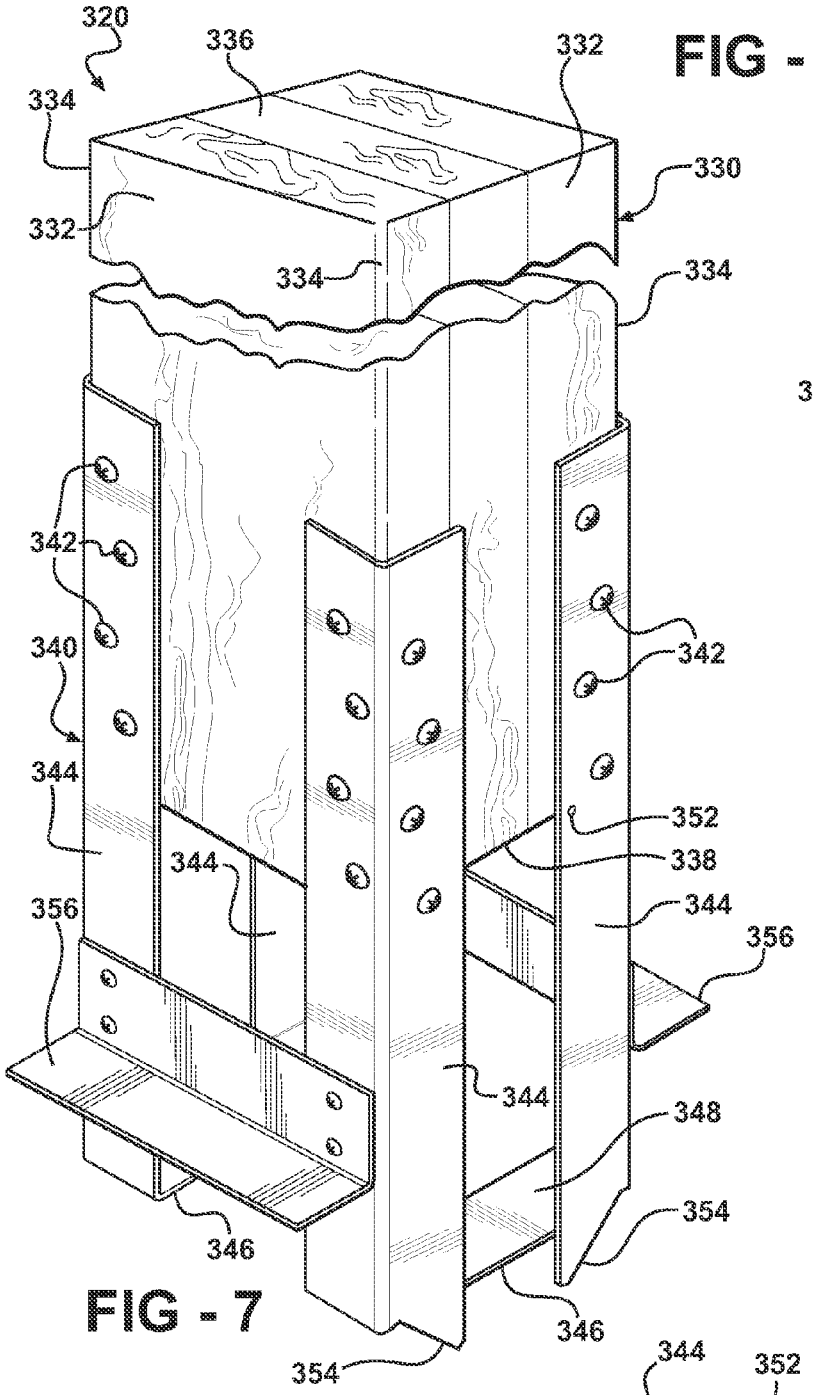
FIG. 7 is a fragmentary perspective view of a third alternative embodiment of the subject column assembly.
Figure 8:
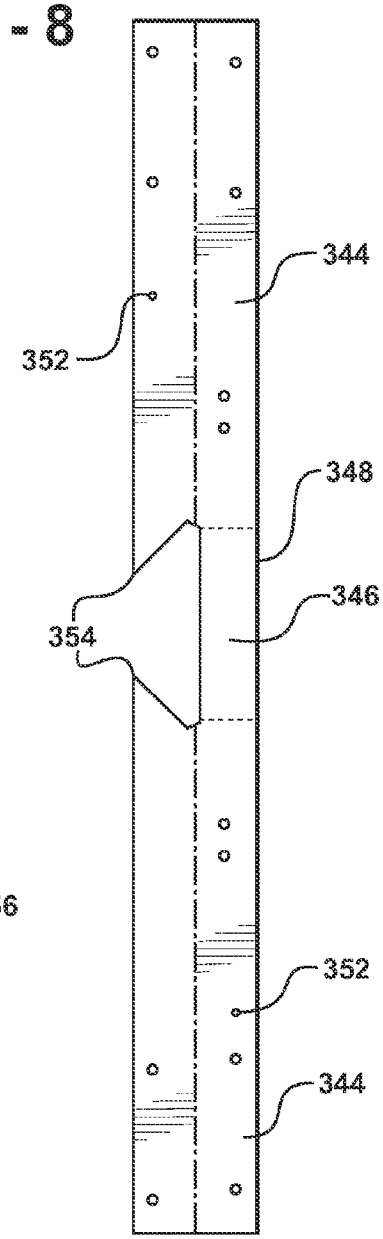
FIG. 8 is a front view of an unformed sheet metal workpiece cut and prepared for subsequent bending to form a section of the -stilt according to the third alternative embodiment.
Figure 9:
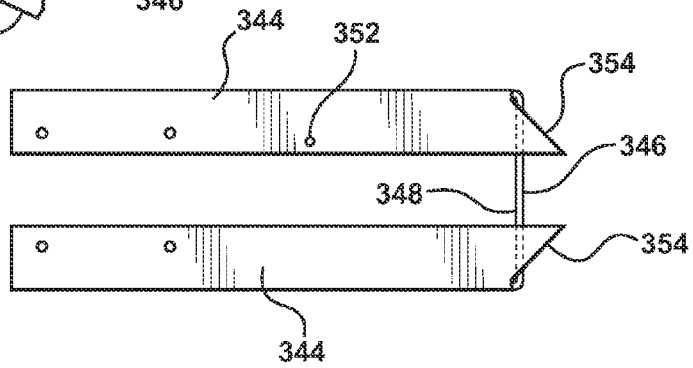
FIG. 9 is a view of the part depicted in FIG. 8 as subsequently bent and shaped into a final operative design.

FIGS. 7-9 represent a third alternative embodiment of the subject invention, wherein like or corresponding parts are described using similar reference numbers preceded by the prefix "3". In this construction, the stilt 340 is made from specially formed and shaped sheet metal components. In FIG. 8, the sheet metal is shown in a cut, but unbent condition with broken lines depicting subsequent bend location. This construction results in an integral, continuously formed base pad 346, lower reinforcing member 348 and two adjacent legs 344. The cleats 354 are shaped with a point to enhance bite into the floor of the hole 224. Also in this design, the upper reinforcing members 356 comprise sections of angle iron attached to the outer surface of the legs 344. These upper reinforcing members 356 are helpful in this embodiment for providing added uplift resistance.

Figure 10:
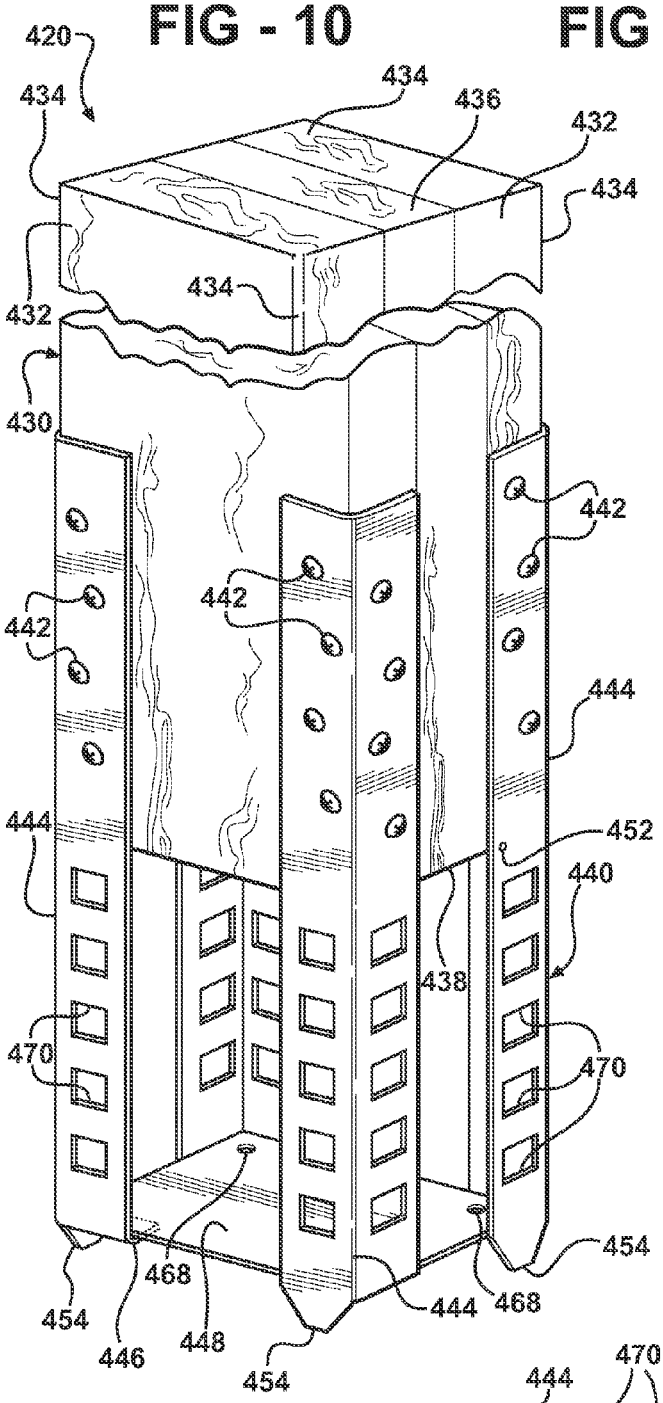
FIG. 10 is a perspective view of a fourth alternative embodiment of the subject column assembly including an optional base plate interconnecting the discrete legs to increase stability.
Figure 11:
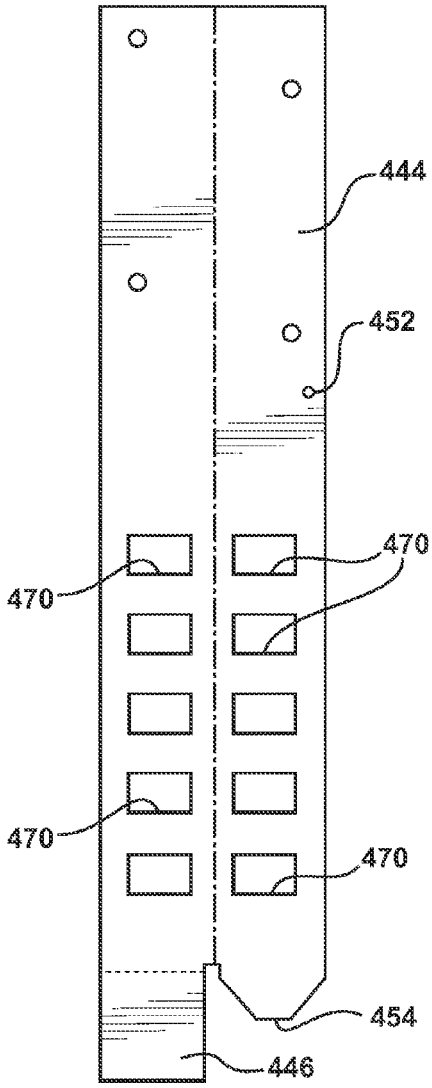
FIG. 11 is a front view of a sheet metal part in a cut but unbent condition for subsequent use in a column assembly according to the fourth alternative embodiment.
Figure 12:
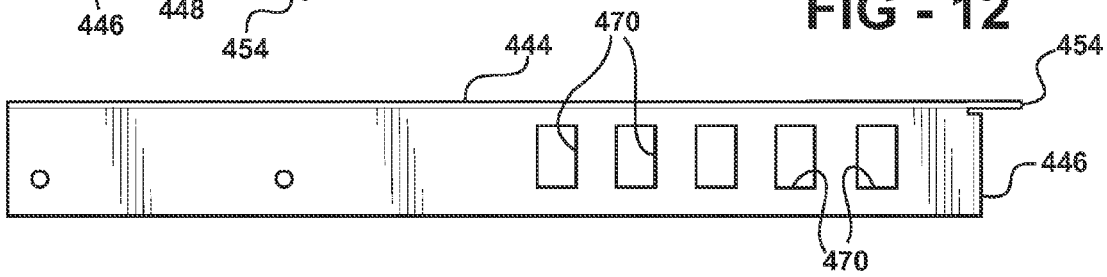
FIG. 12 is a front view of the part of FIG. 11 bent and formed into an operative configuration for subsequent attachment to the bottom end of a post according to the fourth alternative embodiment.

FIGS. 10-12 illustrate a fourth alternative embodiment of the subject invention, wherein like or corresponding parts are described using similar reference numerals preceded by the prefix "4". In this version, the stilt 440 is formed by four independent legs 444 each cut and bent from a single piece of sheet metal. FIGS. 11 and 12 depict a single leg 444 in both pre-bent and post-bent conditions, respectively. Here, the base pad 446 does not function as an integral part of the lower reinforcing member 448. Rather, if a lower reinforcing member 448 is deemed necessary, it is attached to the base pads 446 of each leg 444 as an optional plate-like structure using rivets 468 or by other fastening means. The optional lower reinforcing member is illustrated in FIG. 10. Additional uplift resistance can be accomplished by forming punched holes 470 in the legs 444 which enable concrete to harden inbetween.

The bottom of each leg 444 is provided with a subtly pointed cleat 454 to help stabilize the column assembly 420 in the hole during the concrete fill operation.

The subject invention, in any of the alternative forms depicted herein yields an improved structural column assembly which is inexpensive to manufacture, easy to assemble and enables a building structure to be assembled around the column assembly more quickly than can be achieved using prior art techniques. Furthermore, the unique cleat arrangement helps stabilize the column assembly in the hole 24 during the concrete pour operation. This results in a straighter, better oriented column assembly with which subsequent construction operations can be carried out more accurately and effectively.

The invention has been described in an illustrative manner, and it is to be understood that the terminology which has been used is intended to be in the nature of words of description rather than of limitation. Obviously, many modifications and variations of the present invention are possible in light of the above teachings. It is, therefore, to be understood that within the scope of the appended claims, the invention may be practiced otherwise than as specifically described. The invention is defined by the claims.

What is claimed is:

1. A structural column assembly for temporarily supporting a longitudinally extending post having a top portion and a bottom portion being bedded in a concrete footing formed in situ in a hole having a longitudinal depth measured from a surrounding grade surface to a floor thereof, said assembly comprising:

a stilt disposed in the hole to temporarily support the post in a generally vertical orientation with the bottom portion of the post spaced at a predetermined distance from the earthen floor as a footing of concrete is poured in the earthen hole, the stilt comprising a plurality of generally vertically extending members and a plurality of generally horizontally extending members, wherein at least one horizontal member of the plurality of generally horizontally extending members is connected with two vertical members of the plurality of generally vertically extending members at a radially outer position with respect to the bottom portion of the post, at least one horizontal member of the plurality of generally horizontally extending members is connected with two vertical members of the plurality of generally vertically extending members at a position between the bottom portion of the post and the floor upon the post being temporarily supported in the earthen hole by the stilt, and at least one horizontal member of the plurality of generally horizontally extending members is connected with two vertical members of the plurality of generally vertically extending members at a position adjacent to the floor and wherein the at least one horizontal member is directly connected with the two vertical members adjacent to the floor and includes a portion thereof in contact with the floor.

2. The assembly of claim 1 wherein said stilt is disposed entirely within said earthen hole and fully recessed below said grade surface.

3. The assembly of claim 1 wherein at least one of the generally horizontal members extends around a portion of the cross-sectional perimeter of the post.

4. The assembly of claim 1 wherein at least two vertical members include end portions in contact with the floor.

5. The assembly of claim 1 wherein the plurality of generally vertically extending members and the plurality of generally horizontally extending members form a cage-like frame around the post.

6. The assembly of claim 5 wherein the cage-like frame is substantially rectangular in shape.

7. The assembly of claim 1 wherein at least one of the plurality of generally vertically extending members and at least one of the plurality of generally horizontally extending members are connected to the bottom portion of the post.

8. The assembly of claim 1 wherein at least one of the plurality of generally horizontally extending members contacts the bottom portion of the post.

9. The assembly of claim 1 wherein at least one of the plurality of generally horizontally extending members extends transversely with respect to the post at a position between the bottom portion of the post and the floor upon the post being temporarily supported in the earthen hole by the stilt.

10. The assembly of claim 9 wherein the at least one of the plurality of generally horizontally extending members contacts the bottom portion of the post.

11. The assembly of claim 1 wherein at least one of the plurality of generally vertically extending members contacts the post.

12. The assembly of claim 1 wherein the at least one of the plurality of generally horizontally extending members is connected to the bottom portion of the post.

13. The assembly of claim 1 wherein the plurality of generally vertically extending members and the plurality of generally horizontally extending members are connected to one another to form a structural frame with multiple apertures around the bottom portion of the post.

14. The assembly of claim 1, wherein the plurality of generally vertically extending members and the plurality of generally horizontally extending members comprise elongated members.

15. The assembly of claim 1, wherein the plurality of generally vertically extending members and the plurality of generally horizontally extending members have U-shaped cross-sectional profiles.

16. A structural column assembly bedded in a concrete footing formed in situ in an earthen hole having a longitudinal depth measured from a floor to a grade surface, said assembly comprising:

a longitudinally extending post having a top end and a bottom end, said bottom end disposed toward the floor of said earthen hole and the top end extending above the grade surface;

a stilt including an upper portion and a lower portion, wherein the upper portion of the stilt extends about the periphery of at least a portion of the bottom end of the post and the lower portion of the stilt extends longitudinally from the bottom end of the post to the floor of the hole, the lower portion of the stilt including at least two elongated members extending downward from the bottom portion of the post;

a footing formed of poured concrete disposed in the hole and covering at least a portion of the stilt; and at least one generally perpendicular resting surface directly connected to the bottom end of the at least two elongated members and extending transversely in more than one general direction therefrom, wherein the resting surface is perpendicular relative to the at least two elongated members and contacts the floor of the earthen hole to temporarily stabilize the post in a generally upright orientation.

17. The assembly of claim 16 wherein the lower portion further comprises a plurality of generally downward extending elongated members and generally perpendicularly extending elongated members.

18. The assembly of claim 16 wherein the upper portion further comprises a plurality of generally axially extending elongated members and generally perpendicularly extending elongated members.

19. The assembly of claim 16 wherein the upper portion contacts the bottom portion of the post.

20. The assembly of claim 16 wherein the lower portion includes an extending member in contact with the bottom end of the post, wherein the extending member is generally perpendicular relative to the at least two elongated members.

21. The assembly of claim 16 wherein each elongated member of the at least two elongated members is substantially planar.

22. The assembly of claim 16 wherein the upper portion is engaged with the bottom portion of the post.

23. The assembly of claim 16 wherein the at least two elongated members of the lower portion include two elongated members in opposing positions relative to one another connecting with the generally perpendicular resting surface.

24. The assembly of claim 16, wherein the generally perpendicular resting surface comprises a planar member connected with the at least two elongated members.

25. The assembly of claim 16, wherein the lower portion further comprises a portion extending perpendicularly relative to the at least two elongated members and contacting the bottom portion of the post.

* * * * *